US005537128A

United States Patent [19]

Keene et al.

[11] Patent Number: 5,537,128

[45] Date of Patent: Jul. 16, 1996

[54] SHARED MEMORY FOR SPLIT-PANEL LCD DISPLAY SYSTEMS

[75] Inventors: David Keene, San Mateo; Vlad Bril, Campbell; Dennis Z. Lin, Daly City, all of Calif.

[73] Assignee: Cirrus Logic, Inc., Fremont, Calif.

[21] Appl. No.: 101,770

[22] Filed: Aug. 4, 1993

[51] Int. Cl.[6] ..... G09G 3/00

[52] U.S. Cl. ..... 345/89; 345/98; 345/200

[58] Field of Search ..... 345/87, 89, 104, 345/185, 189, 190, 196, 200, 148, 98, 3.149, 103, 203; 395/164–166, 163, 162; 365/221

[56] References Cited

U.S. PATENT DOCUMENTS

| | | | |
|---|---|---|---|
| 4,998,100 | 3/1991 | Ishii | 345/89 |
| 5,018,076 | 5/1991 | Johary et al. | 345/87 |
| 5,185,602 | 2/1993 | Bassetti, Jr. et al. | 340/793 |
| 5,196,839 | 3/1993 | Johary et al. | 345/148 |
| 5,216,417 | 6/1993 | Honda | 345/89 |
| 5,250,940 | 10/1993 | Valentaten et al. | 345/189 |
| 5,285,192 | 2/1994 | Johary et al. | 345/3 |
| 5,295,328 | 9/1993 | Garrett | 345/149 |
| 5,319,388 | 6/1994 | Mattison et al. | 345/200 |
| 5,335,322 | 8/1994 | Mattison | 345/185 |
| 5,387,923 | 2/1995 | Mattison et al. | 345/103 |
| 5,408,606 | 4/1995 | Eckart | 395/163 |
| 5,422,654 | 6/1995 | Tjandrasuwita et al. | 345/103 |
| 5,432,905 | 7/1995 | Hsieh et al. | 395/162 |

FOREIGN PATENT DOCUMENTS

| | | | |
|---|---|---|---|
| WO90/12389 | 10/1990 | WIPO | G09G 5/00 |

*Primary Examiner*—Steven Saras

*Attorney, Agent, or Firm*—Lowe, Price, LeBlanc & Becker

[57] ABSTRACT

The video memory and the half-frame buffer frame accelerator of a dual scan LCD display are integral in a single memory device. Flat-panel read and write cycles to the frame accelerator designed area inside the memory are optimized in order to minimize memory bandwidth requirements. Extra memory space in the memory device may be used to buffer multiple half-frames of shaded data in such a manner as to save a considerable amount of power in the LCD display graphics system.

11 Claims, 11 Drawing Sheets

SHARED MEMORY FOR SPLIT-PANEL LCD DISPLAY SYSTEMS

BACKGROUND OF THE INVENTION

1. Field of The Invention

The present invention relates to video memory controllers for split-panel LCD displays. More particularly, the invention relates to video memory controllers for split-panel LCD displays in which a frame buffer and frame rate modulation are used to increase the refresh rate of the display.

2. State of the Art

Presently, desktop computers are typically equipped with a VGA color monitor, a cathode ray tube (CRT) having a resolution of 640×480 pixels. Most common are analog RGB monitors capable of displaying practically an unlimited variety of colors. Present day notebook computers, on the other hand, typically have a VGA monochrome liquid crystal display (LCD) or other flat-panel display. Although some notebook computers having color LCD displays are presently being offered, these displays are considerably more expensive than monochrome LCD displays. To increase the versatility of notebook machines, a CRT option is offered whereby the notebook computer may be used to drive an analog RGB display.

A CRT receives as its input a single stream of raster image data and displays this raster image data in a series of lines, which constitute a frame. Single-panel LCD displays operate in a similar manner. For a 640×480 panel, each line is actively displayed for only about 1/480 of the frame period (18 ms for a 60 Hz screen refresh rate). Video data is loaded into a line buffer four consecutive pixels at a time, and at the end of each scan line, the entire data for that line is transferred to a latch register that presents it to the line drivers. The data drives the panel drivers until the next line is loaded into the latch register, and so on.

Split-panel LCDs, on the other hand, are made of two segments, an upper segment and a lower segment, that operate in parallel and that require two parallel streams of data, one for each segment. Referring to FIG. 1A, the split-panel LCD 120 has two separate sets of drivers, one (125) for the upper half of the panel 121 and one (127) for the lower half of the panel 123, that together drive two scan lines simultaneously.

One approach to driving a split-panel LCD display uses a line buffer. Data is fetched from video memory alternately for different LCD display halves. As one scan line is fetched, the other is stored in a scan line buffer, and then both scan lines, one belonging to the upper half of the display and one belonging to the lower half of the display, are shifted out to the flat-panel and displayed. Both display lines are fetched from video memory at VGA graphics mode resolution (4 bits or 8 bits per pixel). If the video memory data path is operated at the same speed as for a CRT display of the same resolution, the resulting frame refresh rate results in poor picture quality. To maintain an acceptable screen refresh rate, the video memory data path in accordance with the line buffer approach has to operate at twice the speed relative to the CRT, resulting in increased power consumption.

In comparison with CRT displays, split-panel LCD displays have therefore not only suffered from (typically) a lack of color but, in many cases, poor display quality.

The lack of display colors may be addressed using a technique known as frame rate modulation. In frame rate modulation, a pixel's illumination state is controlled over the course of successive frames, enabling the visual impression of shades of grey to be produced in addition to the usual black and white of a monochrome display. Frame rate modulation is described, for example, in U.S. Pat. No. 5,185,602.

Using a half-frame buffer, frame rate modulation further enables a higher screen refresh rate to be achieved, addressing the second common drawback of split-panel LCD displays. In effect, frame rate modulation maps color or grey scale video data to be displayed at a pixel onto a temporal sequence of binary display data to be successively displayed at the pixel so as to create a visual impression of a shade of grey at that pixel. At the time the mapping is performed, not only are binary display data to be displayed during a current frame known, but binary data to be displayed during a next frame may also be determined.

Using a half-frame buffer, the video data may be read out of the video memory in the same manner as for CRT display. Referring to FIG. 1B, the left hand side of the figure represents a display sequence beginning at half-frame H. Video data is read out of video memory, first for the upper half-frame and then for the lower half-frame, and converted to binary display data, or shaded data, which is then displayed directly on the LCD display screen. This data, being displayed directly on the LCD display, is referred to as "direct current frame shaded data" (dcfsd). The right hand side of FIG. 1B represents a display sequence beginning one-half frame earlier than the display sequence on the left hand side of the figure, at half-frame (H-1). Otherwise, the two display sequences represent the same events. For each half-frame, as video data is read out of video memory and converted to shaded data, shaded data is produced not only for a current frame but for a next frame also. On both sides of FIG. 1B, the half-frames therefore occur in pairs U,U;L, L;U,U; etc., one-half frame of each pair being current frame shaded data, and another half-frame of each pair being next frame shaded data. The shaded data for the next frame is stored in the half-frame buffer, represented within the dashed lines in the center of FIG. 1B, and is read out of the half-frame buffer and displayed at the time of the next frame. This data is therefore displayed indirectly, via the half-frame buffer, and is referred to as "indirect next frame shaded data" (infsd).

Each half-frame, the contents of the half-frame buffer (upper half-frame or lower half-frame) are read out and displayed on the LCD display (upper half or lower half) before being overwritten by newly produced next frame shaded data. The sequence of operations therefore proceeds as follows:

Read out video data for the upper half-frame;

Convert to shaded data;

Display current shaded data on upper half of LCD panel;

Read out and display on lower half of LCD panel shaded data previously stored in half-frame buffer for lower half-frame;

Overwrite half-frame buffer contents with next shaded data for upper half-frame;

Read out video data for the lower half-frame;

Convert to shaded data;

Display current shaded data on lower half of LCD panel;

Read out and display on upper half-frame of LCD panel shaded data previously stored in half-frame buffer for upper half-frame; and Overwrite half-frame buffer contents with next shaded data for lower half-frame; etc.

Twice as many frames are displayed on the LCD panel as would be displayed on a CRT during the same time. The full LCD displays are therefore given the reference numerals 1.1, 1.2, 2.1, 2.2, etc., the integer portion of the reference numeral corresponding to CRT frame times and the decimal portion corresponding to a first or second LCD frame time within each CRT frame time. Because the frame rate is doubled as compared to a conventional CRT, the apparatus performing the described operations is referred to as a "frame accelerator".

Prior art flat-panel graphics controllers (such as the CL-GD6410 flat-panel graphics controller of the assignee) used an independent memory device, usually a 64K×4 or a 256K×4 dynamic random access memory (DRAM) as a half-frame buffer and frame accelerator for split-panel, dual-scan LCD displays. FIG. 2 illustrates a system solution using separate DRAMs for video memory and the half-frame buffer frame accelerator. Since at the time only 256K bit and 1M bit DRAMs were available, and since VGA displays require 2M bit of video memory, several DRAM devices were required just to implement the video memory. An additional DRAM having its control signals tightly coupled to the video data clock was used to implement the half-frame buffer. As a result, the DRAMs used for video memory were totally decoupled from the DRAM used for the half-frame buffer and for frame acceleration. In other words, the two memory arrays had separate address, data and control signals and operated out of synch with each other. Specifically, the frame accelerator operated off the video data clock (25 MHz or lower frequency), while the video memory controller operated off an independent higher frequency clock (Memory Clock, or MCLK) having a frequency of 36 MHz to 50 MHz, depending on the DRAM speed used. This arrangement simplified the system design, inasmuch as the data to and from the frame accelerator was exchanged at the speed of the video data clock.

The block diagram of FIG. 3 shows in greater detail the dual scan LCD flat-panel VGA graphics controller system of FIG. 2, with its separate DRAMs for video memory and for the half-frame buffer frame accelerator. Two independent DRAM controllers, the video memory controller VMC and the frame accelerator DRAM controller 21, operate off two different clocks (the memory clock and the video dock clock, respectively). The frame accelerator DRAM controller 21 executes read-modify-write cycles to the 64K×4 or 256K×4 DRAM, reading the indirect data for one flat-panel half and immediately writing the new data for the current flat-panel half, but with the frame modulation for the next frame.

The blocks 23, 25, 27, 29, 31, 33, 35, and 37 in FIG. 3 are common to virtually all VGA controllers and operate in a manner well-known in the art to provide an analog RGB signal to a CRT. The LCD block 40 and the frame accelerator 50, realized by the frame accelerator DRAM controller 21 and the half-frame buffer 47, provide frame rate modulated upper data and lower data at an accelerated frame rate to a monochrome dual scan flat-panel 51. Within the LCD Block 40, a Sum-to-Grey block 41 receives an 18 bit digital RGB signal produced by the VGA ram 33 (6 bits for each color R, G and B) and performs a summing operation to produce 6 bits of grey scale data. From the 6 bit grey scale data, the frame rate modulation block 43 produces shaded data, 1 bit of current frame shaded data (csfd) and 1 bit of next frame shaded data (nfsd). Four bits of current frame shaded data and 4 bits of next frame shaded data are accumulated in a dual 1-to-4 serial-to-parallel converter 35. The 4 bits of current frame shaded data (dcsfd) are displayed directly on the monochrome dual scan flat-panel 51, and the next frame shaded data is input to the frame accelerator 50. At the same time, indirect current frame shaded data (icsfd) previously stored in the half-frame buffer is output by the frame accelerator and displayed on the monochrome dual scan flat-panel 51. The direct current frame shaded data and the indirect current frame shaded data may be displayed on either the upper panel or the lower panel of the monochrome dual scan flat-panel 51 in accordance with a control signal produced by the LCD Block 40.

With the advent of 16M bit DRAMs, there is now available in one memory device sufficient memory space to physically accommodate both the VGA video memory and the required 19.2 KByte half-frame buffer with considerable memory space to spare. Integration of both the video memory and the dual scan LCD display half-frame buffer frame accelerator in one memory device would reduce considerably the form factor of a dual scan LCD display controller system without affecting frame refresh rate or picture quality. Power savings would also be achieved relative to the use of two memory arrays and relative to the line buffer approach of driving dual scan panels, which requires higher video clock rates to achieve similar results in screen refresh rates. Because dual scan LCD displays are used mostly with portable systems working on a battery, saving power in the LCD display system is very important in order to extend the time a system can operate without a battery recharge.

Significant technical obstacles, however, have prevented the video memory and the half-frame buffer frame accelerator from being previously integrated in one memory device. Frame accelerator integration in one DRAM leads to a performance bottleneck related to DRAM bus bandwidth. Normal video memory read cycles, CPU read and write memory cycles to video memory, memory refresh cycles, and flat-panel read and write cycles to and from the frame accelerator all compete for DRAM bandwidth.

SUMMARY OF THE INVENTION

The present invention, generally speaking, integrates both the video memory and the half-frame buffer frame accelerator of a dual scan LCD display in a single-memory device. Flat-panel read and write cycles to the frame accelerator designated area inside the memory are optimized in order to minimize memory bandwidth requirements. Extra memory space in the memory device may be used to buffer multiple half-frames of shaded data in such a manner as to save a considerable amount of power in the LCD display graphics system.

In accordance to one broad aspect of the invention, a flat-panel display apparatus includes a flat-panel display device including a plurality of display panels, a single memory array having a display memory area and a frame buffer area, and video controller circuitry for causing video information to be displayed on the flat-panel display device by reading display data from the display memory area of the single memory array and by storing display data into and retrieving display data from the frame buffer area of the single memory array. Preferably, the video controller circuitry includes a flat-panel write cycle FIFO, a flat-panel read cycle FIFO, and FIFO full and FIFO empty logic interacting with a memory cycle arbitration and sequencer unit that decides when and what type of memory cycles to execute. A write address generator maintains the separation of frame buffer data and display memory data and maximizes the number of memory cycles that are paged memory cycles when accessing the frame buffer. The video controller circuitry also preferably includes a CRT read cycle FIFO, allowing the same memory device to be shared between CRT display memory and the frame buffer. CRT read cycle FIFO full and empty logic interacts with the memory cycle arbitration and sequencer unit.

In accordance with another broad aspect of the present invention, video data is displayed on a flat-panel display device having a plurality of display panels by producing video data corresponding to a first picture element to be displayed on one of the plurality of display panels, mapping the video data corresponding to the first picture element onto a first temporal sequence of display data to be successively displayed at the first picture element to create at the first picture element a visual impression in accordance with the video data, sending a first one of the display data in the first temporal sequence to the one display panel, storing a plurality of the later occurring display data in a buffer memory, and, during a same screen refresh cycle, retrieving from the buffer memory a display data previously stored in the buffer memory and sending the display data to another of the plurality of display panels. During a next screen refresh cycle, a display data stored during the previous screen refresh cycle is retrieved from the buffer memory and sent to the one display panel for display at the first picture element. During each of a following screen refresh cycle after the next screen refresh cycle and a next following screen refresh cycle after the following screen refresh cycle, a display data previously stored in the buffer memory is retrieved and sent to one of the plurality of display panels, and a display data stored in the buffer memory is retrieved and sent to the other of the plurality of display panels. In other words, multiple frames of shaded data are stored ahead such that during one or more display frames all of the display data is indirect display data retrieved from the buffer memory without accessing display memory.

BRIEF DESCRIPTION OF THE DRAWINGS

The present invention may be further understood from the following description in conjunction with the appended drawings. In the drawings.

DETAILED DESCRIPTION OF THE PREFERRED EMBODIMENT

Figure 4:
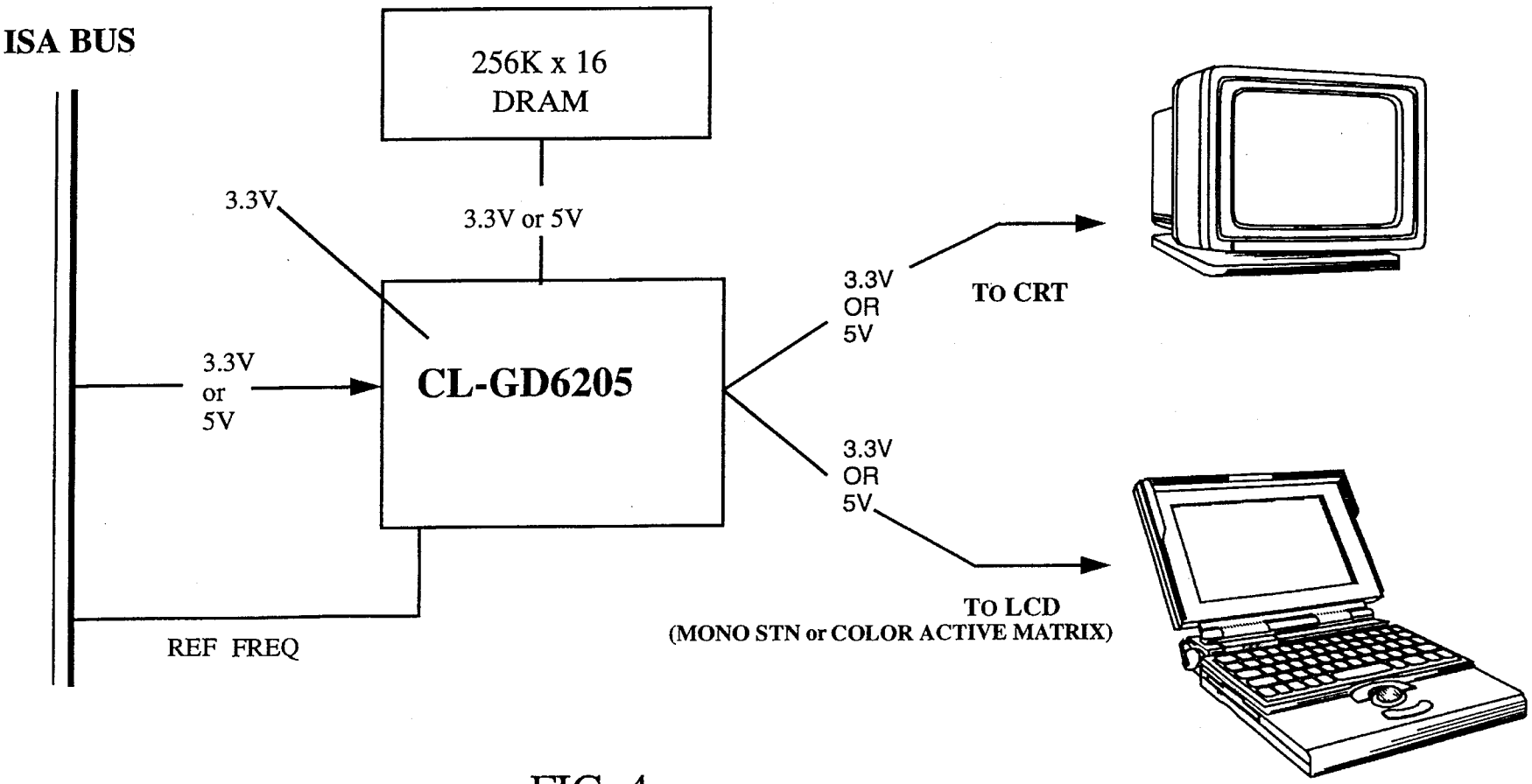
FIG. 4 is a generic system diagram of a dual scan monochrome flat-panel VGA controller with video memory and a frame accelerator integrated into a single DRAM.

Referring to FIG. 4, in the present VGA controller system, a single 256K×16 DRAM is use to drive a dual scan LCD panel by itself or at the same time as a CRT display. The frame accelerator is defined as an array inside the 256K×16 DRAM (providing a total of 512 KBytes of memory), outside VGA memory space, which is 256 KBytes.

Figure 5:
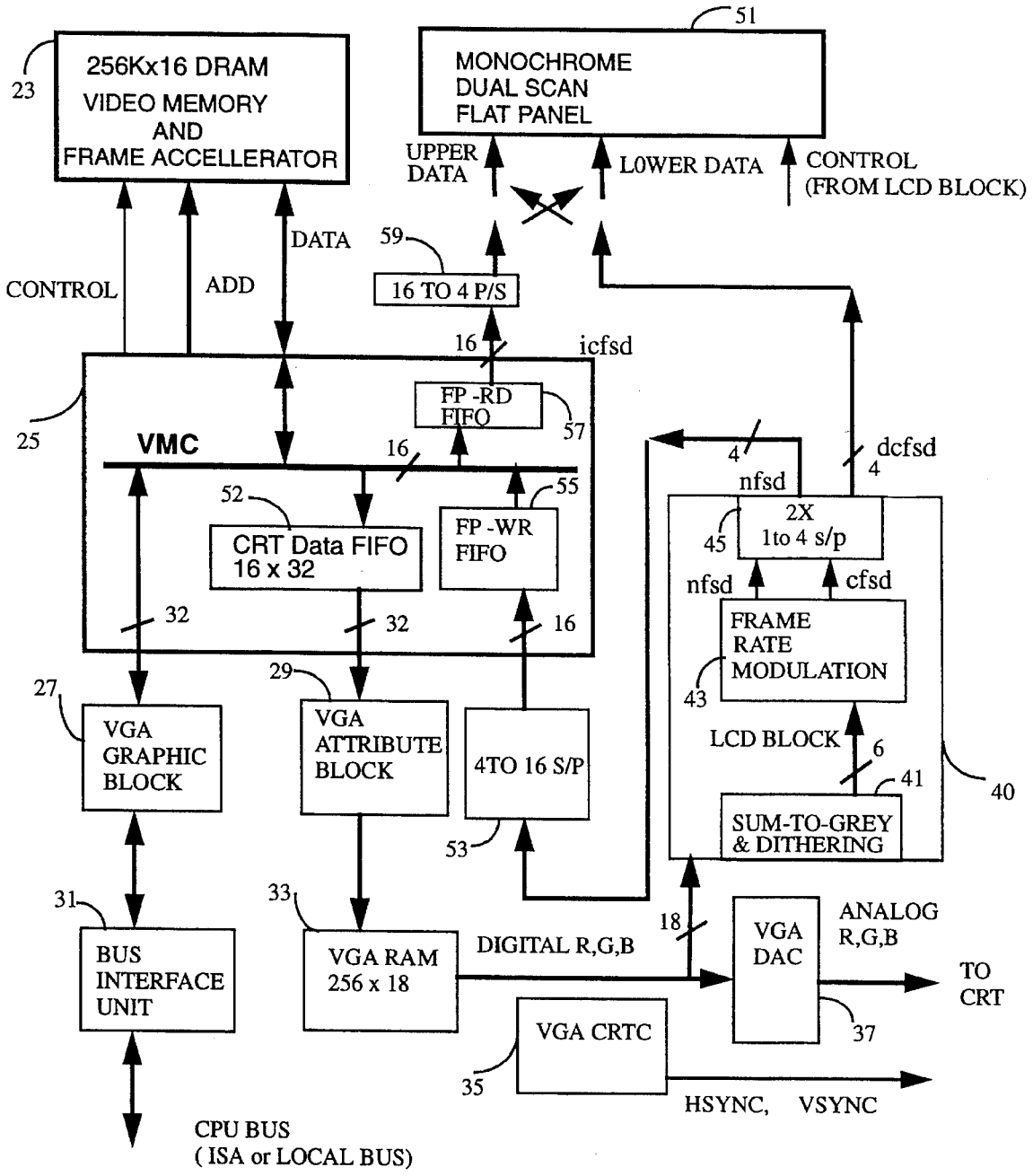
FIG. 5 is a more detailed block diagram of the system of FIG. 4.

The block diagram of FIG. 5 shows in greater detail the flat-panel VGA controller system of FIG. 4, which is able to drive a dual scan monochrome LCD panel using a single 256K×16 DRAM. In comparison with the system of FIG. 3, the frame accelerator 50 of FIG. 3 is absent in FIG. 5, the half-frame buffer 47 having been integrated into the 256K×16 DRAM 23 and the function of the frame accelerator DRAM controller 21 having been incorporated into the video memory controller 25.

Figure 3:
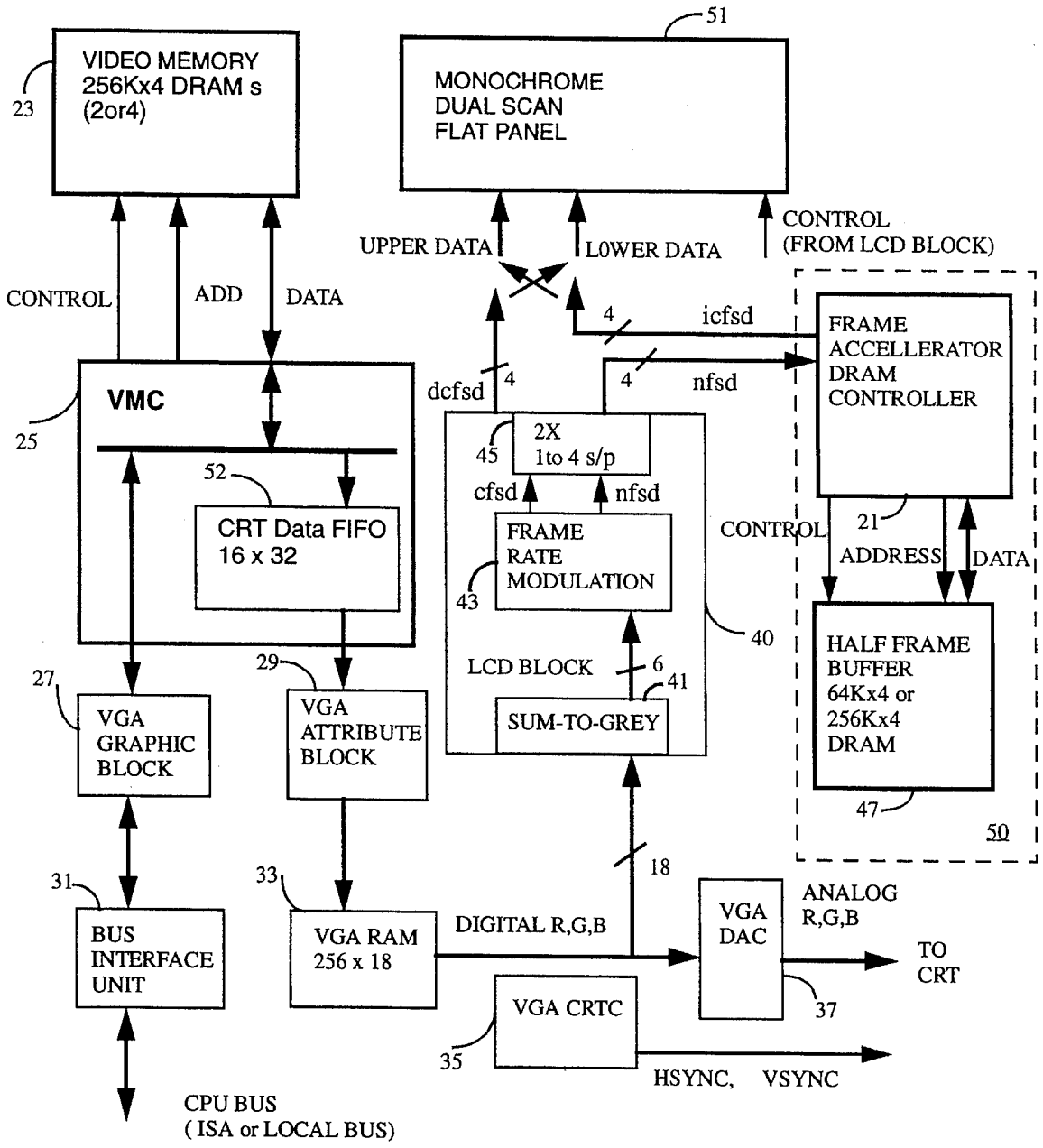
FIG. 3 PRIOR ART
FIG. 3 is a more detailed block diagram of the system of FIG. 2.

FIG. 5 includes in addition to the blocks shown in FIG. 3 blocks 53, 55, 57 and 59. Blocks 53 and 59 are data formatters for converting frame-rate-modulated grey shade data from the panel format (4 bits wide for monochrome dual scan panels) to the 16 bit wide DRAM format, and for converting 16 bit wide format data read from the DRAM to the panel format, respectively. The blocks 55 and 57 are flat-panel FIFOs, a write FIFO and a read FIFO, respectively.

Figure 1A:
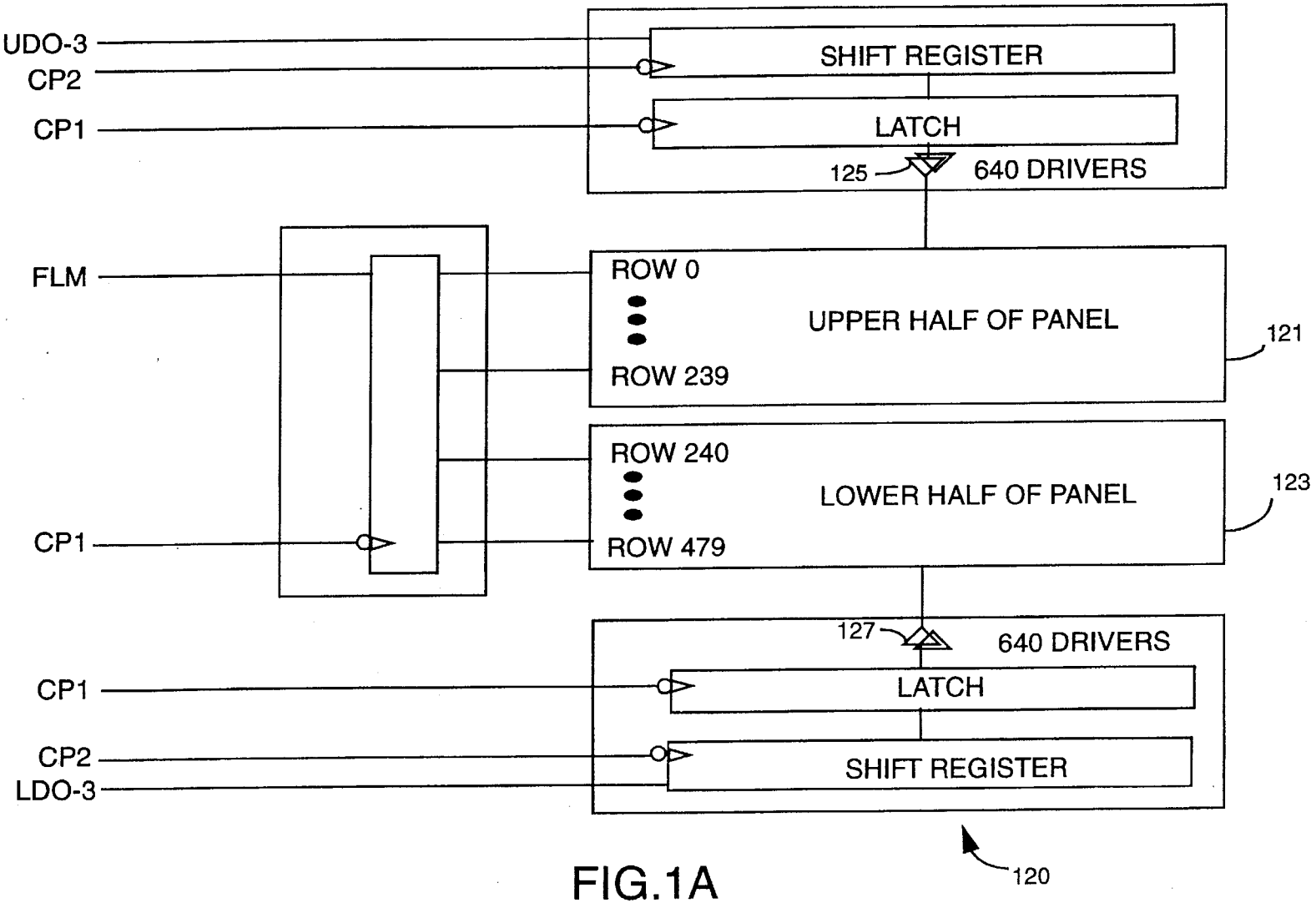
FIG.1A PRIOR ART
FIG. 1A is a block diagram of a dual scan monochrome display panel.
Figure 1B:
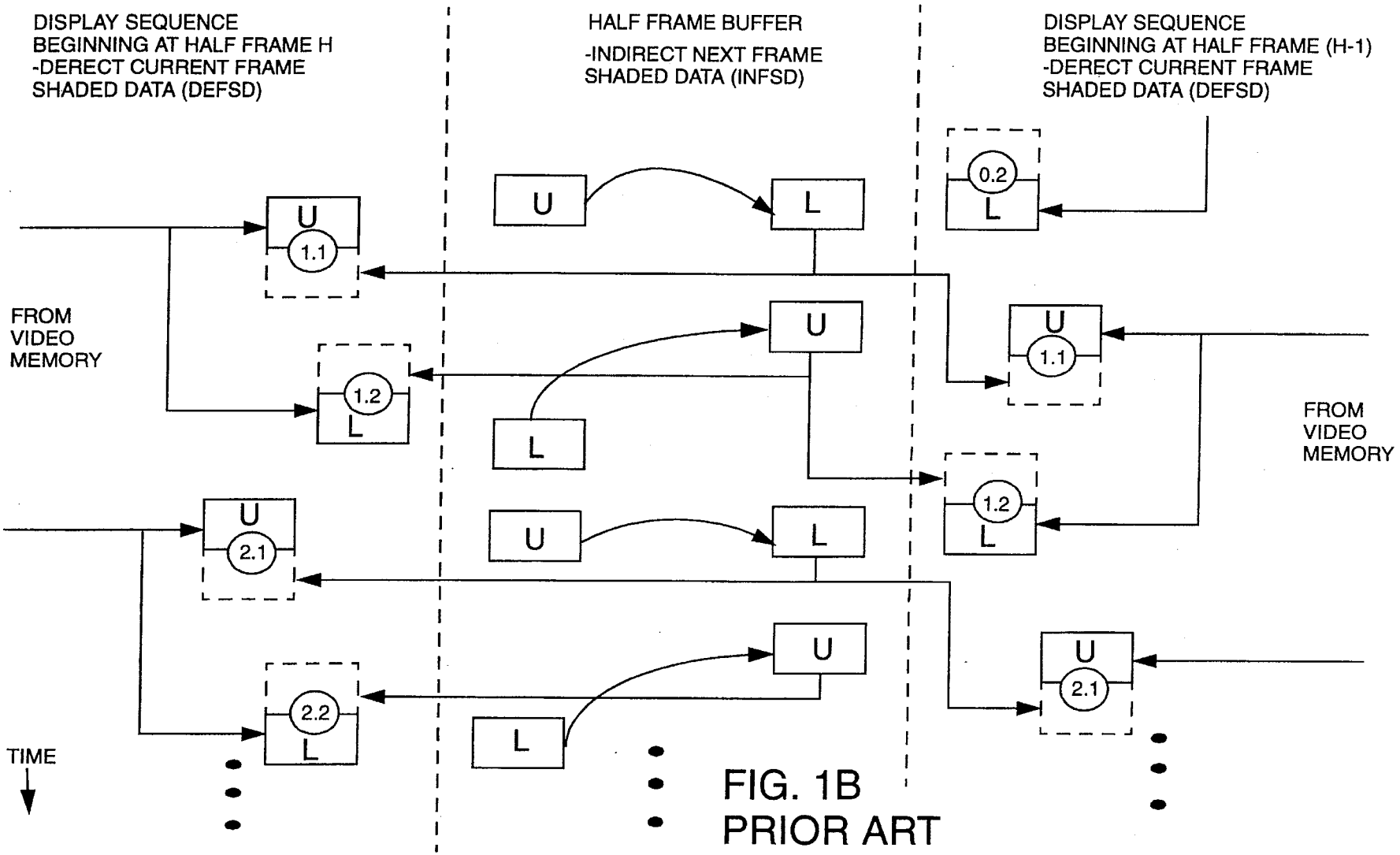
FIG. 1B PRIOR ART
FIG. 1B is a diagram of the display sequence for a prior-art half-frame buffer.
Figure 2:
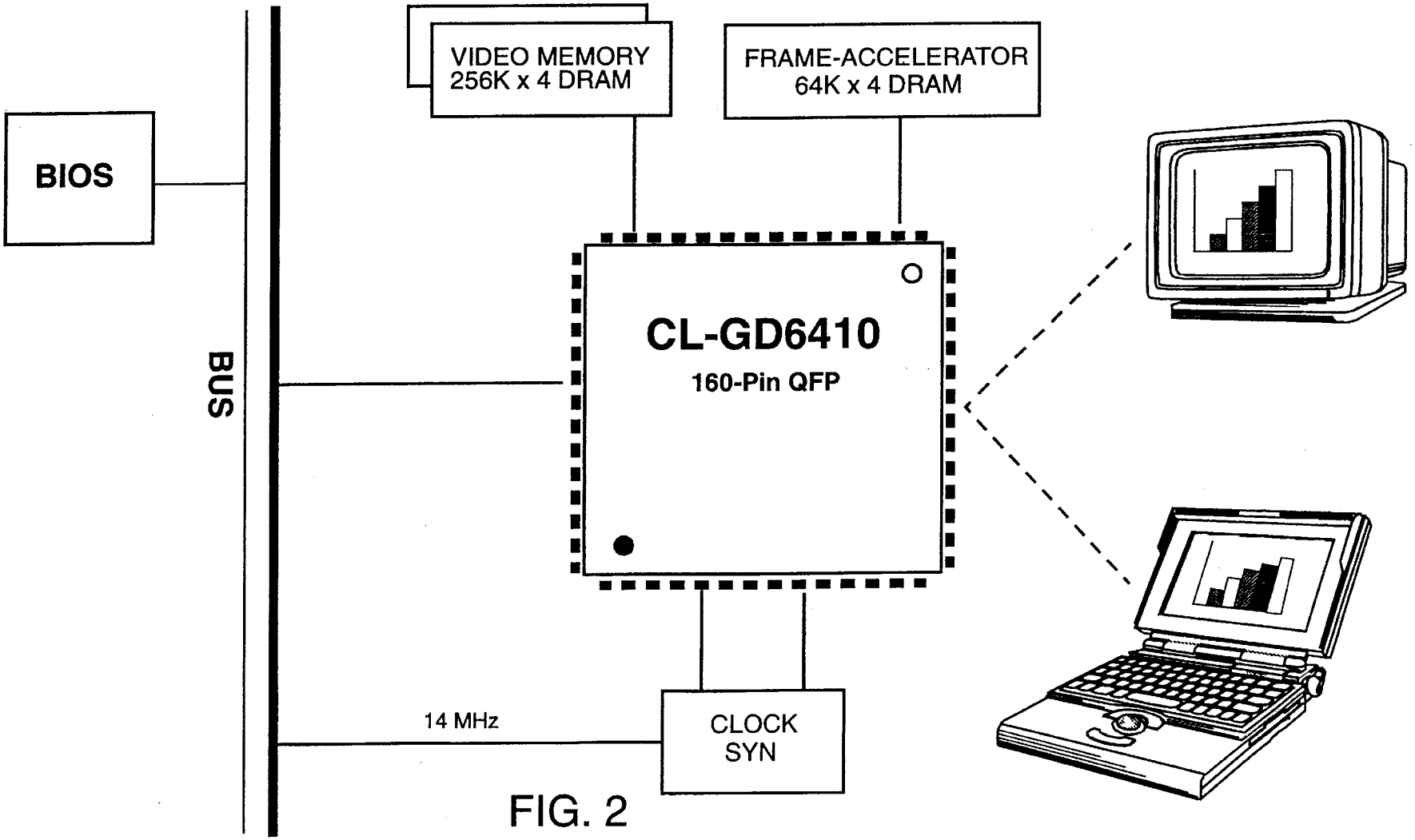
FIG. 2 PRIOR ART
FIG. 2 is a generic system diagram of a dual scan monochrome flat-panel VGA controller with separate DRAMs for video memory and for a frame accelerator.

Indirect flat-panel video data is generated every LCD panel shift clock (CP2 in FIG. 1A), 4 bits representing 4 pixels. The indirect flat-panel video data is first converted to 16 bit words in the 4-to-16 serial-to-parallel converter 53, to fit the DRAM width, and then stored, without losing any data, into an intermediate storage area provided by the flat-panel Write first-in-first-out buffer (FP-WR-FIFO). Every time indirect flat-panel video data is sent by the LCD block in FIG. 5 to the Write FIFO, a 16 bit word is also read from the flat-panel Read first-in-first-out buffer 57 (FP-RD-FIFO) and is sent to one-half of the LCD flat-panel, 4 bits every shift clock. The 16-to-4 parallel-to-serial converter converts the data from the width of 16 bits to a width of 4 bits and is clocked by the shift clock. Data therefore goes in the write FIFO and comes out of the read FIFO at the same speed, 4 pixels per LCD panel shift clock, with a 1-bit-per-pixel representation.

If the Write FIFO and the Read FIFO are precisely the same size, then the moment the write FIFO becomes full, the read FIFO becomes empty. When either condition occurs (Write FIFO full or Read FIFO empty) a request for a memory access to write the contents of the Write FIFO into memory and to Read from memory new data to be placed in the read FIFO is sent to the video memory controller arbiter (not shown). As soon as the current memory cycle is completed, in the case of a CPU access, or a CRT video memory read is completed, flat-panel memory cycles are performed in order to empty the Write FIFO and to fill the Read FIFO. Memory cycles used to empty the Write FIFO and fill the Read FIFO are referred to hereinafter as "flat-panel cycles" or "FP cycles".

In order to store a single half-frame, the minimum size of the half-frame buffer frame accelerator is 19.2 KBytes, calculated as follows:

640 pixels/scan line * 240 scan lines * 1 bit/pixel * 1 byte/8 bits.

In the simplest case, a fully contiguous half-frame buffer memory mapping may be used. The memory controller must then be able to tell when a DRAM page boundary occurs in order to select the appropriate type of memory cycle, i.e., execute a random cycle instead of the normal page cycle. The half-frame buffer may be organized instead such that a page boundary occurs always at the beginning of a new scan line fetch. For instance, the memory controller might store 12 scan lines in the memory page and then jump to another memory page. In this case, 480 words out of 512 per DRAM page is used in each DRAM page assigned to the half-frame buffer. Storing 480 scan lines 12 scan lines to a page requires a total of 40 DRAM pages out of 512 available DRAM pages to be used for the DRAM-embedded half-frame buffer frame accelerator. A similar approach may be adapted to any type of DRAM memory array in accordance with the page size and the number and size of DRAMs used.

The Write FIFO insures that all pixel data coming from the LCD block as indirect video data is stored in memory. The Read FIFO insures that the data to be displayed on the dual scan LCD panel is available when needed for display. No pixel can be lost or not displayed. The Read FIFO is therefore designed to have enough storage area to supply the dual scan LCD flat-panel with data starting from the moment that the Read FIFO has been filled and other types of memory cycles (CRT memory access cycles and CPU memory access cycles) are executed until the moment at least one Read FIFO stage is filled again.

CPU memory access cycles, or "CPU cycles", are memory read or write cycles requested by the CPU bus (ISA, PI or local bus). CRT memory access cycles, or "CRT cycles", are memory read cycles that are used in order to display data on a CRT display or, in an LCD-only mode, in order to fetch data, process it and then send it to the Sum-to-Grey and Dithering block. This data can be 1, 2, 4, 8, or even 16 bits per pixel. This CRT video data fetched from memory during the CRT cycles is converted to LCD panel 1-bit-per-pixel data through sum-to-grey and frame-rate-modulated grey shading. Two streams of data are generated: direct data that is sent to the panel, and indirect data that is sent to the half-frame buffer frame accelerator and is later retrieved from the 256K×16 DRAM, stored in the Read FIFO, and sent to the panel 4 bits at a time every shift clock.

In addition to CPU cycles and CRT cycles, memory access cycles are required to read and write the memory in order to store and retrieve the indirect video data. These memory access cycles are referred to hereinafter as "frame accelerator cycles". CRT cycles, CPU cycles, and frame accelerator cycles have to be arbited, since requests for their execution can occur simultaneously. CRT cycles are given the highest priority, frame accelerator cycles are given the next highest priority, and CPU cycles are given the lowest priority. This prioritization insures that correct data is displayed. Neither the VGA attribute block 29 of FIG. 5 nor the LCD Block 40 of FIG. 5 can wait without affecting the display. The CPU, on the other hand, can be forced to wait by inserting wait states.

By accumulating data in the Read and Write FIFOs, DRAM page cycles can be used to increase the memory bandwidth. The Read and Write FIFOs are used as synchronous data buffers between blocks with asynchronous clocks. In a preferred embodiment, the video memory controller 25 is clocked by the memory clock (typically 41.7 MHz) and the VGA attribute block 29, the VGA DRAM 33 and LCD Block 40 are clocked by the video dock clock (typically 25.175 MHz).

Memory bandwidth utilization may be further improved using a look-ahead Read FIFO technique in order to save the time required by a DRAM in order to switch from a read to a write sequence. Every time the DRAM is first read and then written, one or two extra memory clocks are required to meet the DRAM specification. This time is used by the DRAM circuitry in order to switch the bi-directional data bus from an output mode (in which the DRAM drives the data bus) to an input mode (in which the DRAM controller, external to the DRAM integrated circuit, drives the data bus). A typical DRAM requires a minimum of approximately 30 ns to guarantee that it has stopped driving the data bus after being in output mode. In an exemplary embodiment, the Write FIFO contains 8 stages of 16 bit words and the Read FIFO contains 8 stages of 16 bit words. Four stages of the Read FIFO and four stages of the Write FIFO are always read or written from memory in a fixed sequence.

Figure 6:
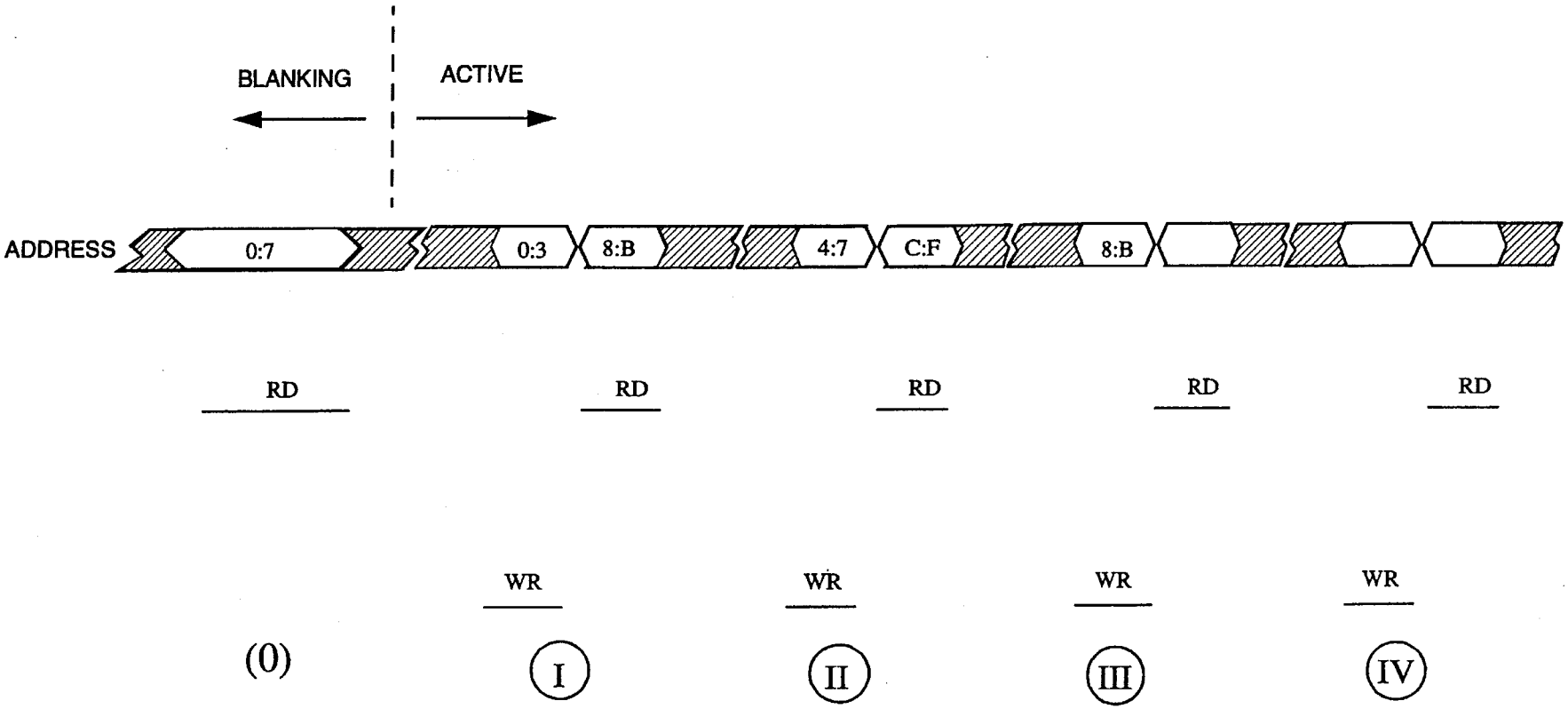
FIG. 6 is a timing diagram illustrating a flat-panel FIFO write-before-read sequence.

At the end of each flat-panel half-frame, both the Read FIFO and the Write FIFO are flushed, i.e., their pointers are reset to zero. Address counters for the half-frame buffer are also reset to zero. As represented in FIG. 6, an initial read FIFO fill cycle is executed during vertical non-display time in which all 8 stages are filled with indirect data for the next flat-panel half-frame. Following the initial read FIFO fill cycle, the half-frame buffer read address is 8, while the half-frame buffer write address remains at zero. Sometime after the start of active display time, the Write FIFO will have accumulated four 16 bit stages of indirect data from the LCD Block 40. A request is then made for half-frame buffer memory accesses which, when granted, causes four Write FIFOs stages to be written to memory at addresses 0–3 of the half-frame buffer memory area. Since addresses 0–7 were previously read during the initial Read FIFO fill cycle, no data is lost by overwriting addresses at 0–3. Immediately after the four half-frame buffer memory write cycles, four half-frame buffer memory read cycles are executed at addresses 8 to B of the half-frame buffer. This completes one half-frame buffer memory access. Other types of memory accesses may then occur (CPU, CRT Refresh, and so on), until the Write FIFO again contains four 16 bit stages full of new data from LCD Block 40.

In the foregoing manner, in one uninterrupted paged access, four memory write accesses and four memory read accesses to the half-frame buffer are performed with the write accesses taking place first in a paged sequence without overwriting half-frame buffer data not previously read. Because switching from a write paged cycle to a read paged cycle does not require any additional time, this method of half-frame buffer access is faster and requires less memory bandwidth than other alternative methods of half-frame buffer access. Preferably, the half-frame buffer addressing scheme is such that memory page boundaries are not crossed during display time by either write or read address generators.

Figure 7:
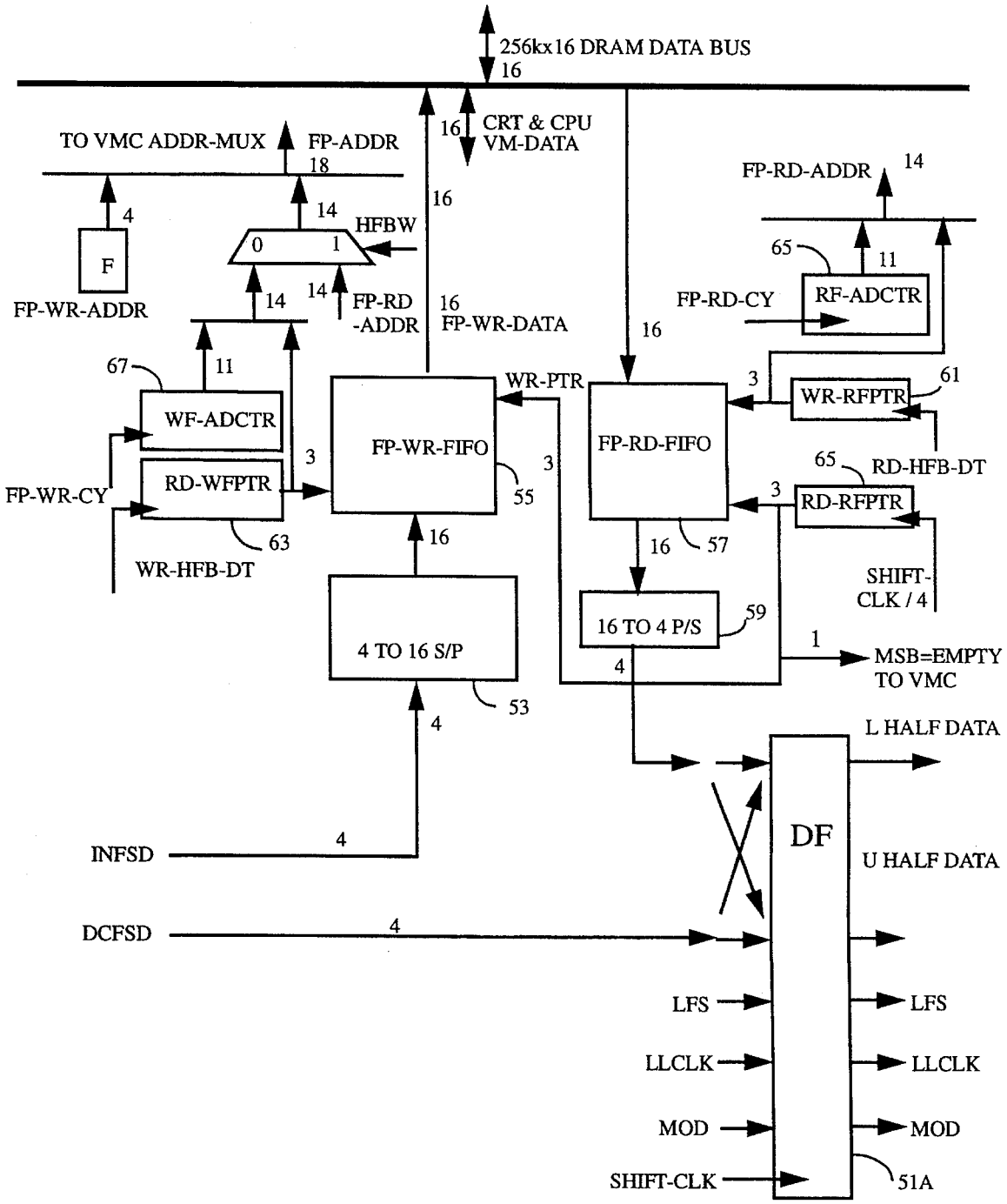
FIG. 7 is a block diagram showing in greater detail the video memory controller of FIG. 5.

FIG. 7 illustrates in greater detail an exemplary embodiment of a portion of the video memory controller 25 that implements the described flat-panel Read FIFO approach. The Write FIFO 55 and the Read FIFO 57 each require a write pointer and a read pointer. For 8-stage FIFOs, the pointers may be 3 bits in length. The Read FIFO write pointer 61 (WR-RFPTR) is incremented each time data is read from the half-frame buffer in accordance with a signal rd-hfb-dt. The Write FIFO read pointer (RD-WRFPTR) 63 is incremented each time data is written to the half-frame buffer in accordance with a signal wr-hfb-dt. A single physical pointer 65 is used as both the Read FIFO read pointer and the Write FIFO write pointer, inasmuch as every 4 shift clocks one 16 bit word of data is read from the Read FIFO to be displayed on the dual scan flat-panel and one 16 bit word is written into the Write FIFO to be stored into the half-frame buffer accelerator resident in the 256K×16 DRAM. The shift clock is represented as CP2 in FIG. 1A.

Because half-frame buffer accelerator read and write addresses are different (the read address is ahead), two half-frame buffer address counters are provided, a half-frame buffer address counter 65 for half-frame buffer read cycles and a half-frame buffer address counter 67 for half-frame buffer write cycles. The half-frame buffer address counters are clocked on the training edges of CAS* signals generated for each type of memory cycle: half-frame buffer read cycle (fp-rd-cy) and half-frame buffer write cycle (fp-wr-cy). In a fully linear address scheme of the type shown in FIG. 7, the Read FIFO write pointer 61 forms the least significant 3 bits of the half-frame buffer read cycle address, while the Write FIFO read pointer 63 provides the least significant 3 bits of the half-frame buffer write cycle address. The two half-frame buffer addresses, one for read cycles (FP-RD-ADDR) and one for write cycles (FP-WR-ADDR), each 14 bits, are multiplexed in accordance with a half-frame buffer write signal HFBW. A constant (F in hexadecimal in FIG. 7) is added to the most significant 4 bits in order to place the half-frame buffer in the upper address half of the 256K×16 DRAM. The resulting address is further multiplexer with addresses for other types of memory cycles, such as CRT video memory read cycles and CPU memory cycles.

Because of the frame modulation to produce shades of grey, video data sent to the panel changes every frame even if the image to be displayed is not changed. If grey shading data for several frames could be generated, saved in the 256K×16 DRAM and retrieved when needed, fewer memory accesses would be required over the course of several frames, because the same video memory data would not need to be fetched every frame. Frame accelerator operation as described thus far may be extended to use additional available space in the DRAM so as to reduce the required number of memory accesses.

In normal flat-panel operation with a frame accelerator, video memory data is fetched every frame as 4 bit per pixel or 8 bit per pixel data and then converted to 1 bit per pixel for monochrome panels and 3 bits per panel for color panels. Because shaded data is more compact than video memory data, generating frame modulated data once for multiple frame results in fewer memory cycles overall even after the frame modulated data has been saved into and subsequently retrieved from the 256K×16 DRAM. In 4 bit per pixel and 8 bit per pixel graphics modes, 1 bit per pixel shaded data results in 2:1 and 4:1 data compression ratios, respectively. In 8 bit per pixel graphics mode, 3 bits per pixel shaded data results in a compression ratio of 8:6. In 4 bits per pixel graphics mode, a 3 bits per pixel shaded data representation results in more memory cycles overall. Extended frame accelerator operation would therefore not be used.

Figure 8:
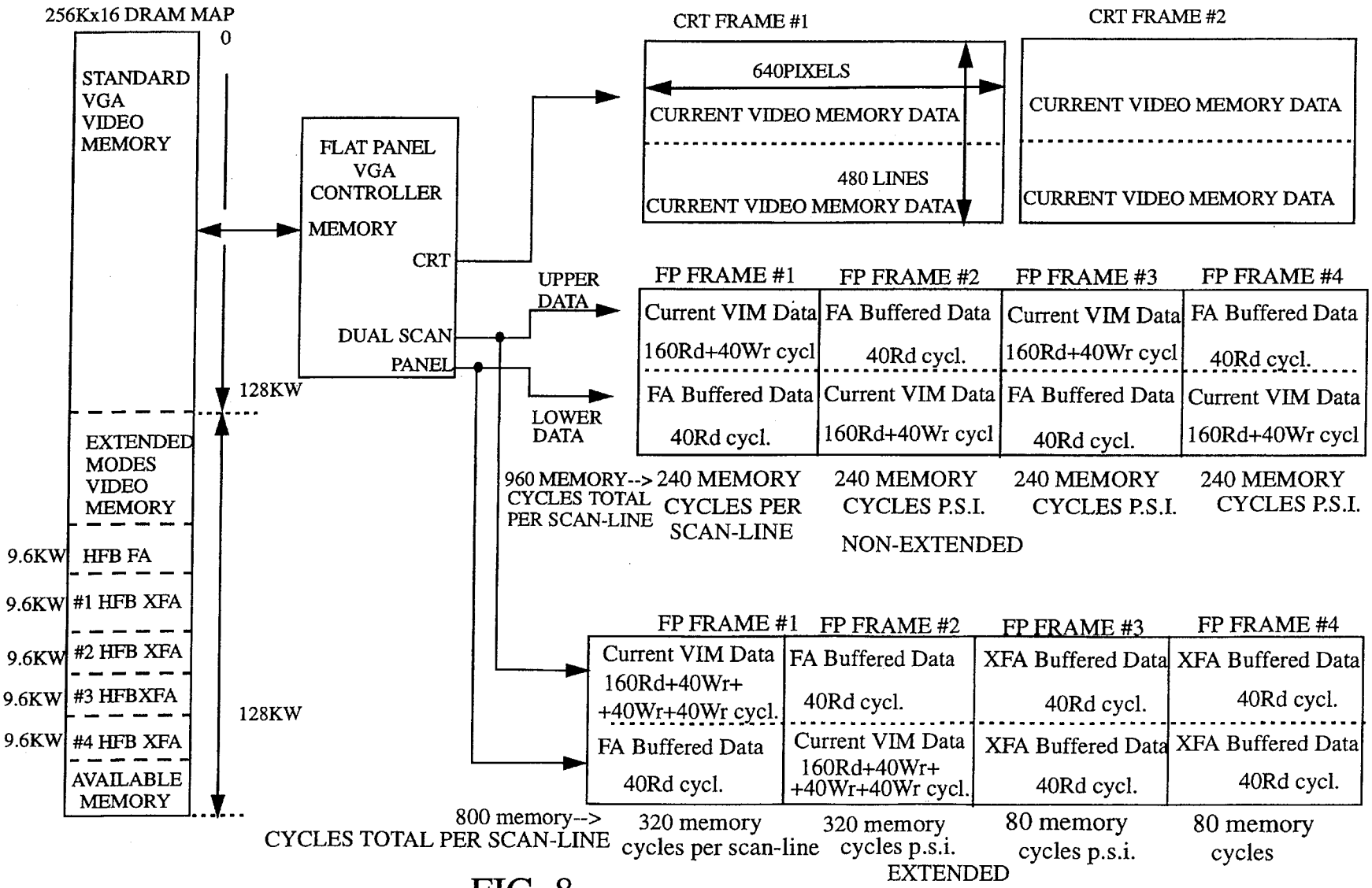
FIG. 8 is a diagram illustrating extended buffer operation.

FIGS. 8 compares non-extended and extended frame accelerator operation for a dual scan 640×480 LCD panel and a 256K×16 DRAM. Four bit per pixel graphics mode is assumed. Over four flat-panel frames, using the non-extended half-frame buffer frame acceleration approach, a total of 960 memory accesses will be executed per scan line display time (counting only CRT and frame buffer cycles). Using an extended frame accelerator approach applied over four flat-panel frames, only 800 memory accesses are executed per scan line display, resulting in a savings of 160/960=16.6% in overall memory bandwidth utilization. The 256K×16 DRAM is allocated in accordance with the memory map shown in FIG. 8. Half of the DRAM (128K×16 locations) is allocated to the standard VGA video memory. Out of the remaining 128K×16 DRAM locations, some portion may be used for non-VGA graphics modes such as 640×480 8-bits-per-pixel mode or for other purposes such as a hardware cursor memory map or as temporary graphics storage.

Using an integrated half-frame buffer frame accelerator of the type described in connection with FIG. 5, 9.6×16 of the remaining 128K×16 DRAM locations are used as the half-frame buffer memory array. For a linear memory map, a half-frame of 640×240 pixels requires 640×240/16=9,600 memory locations. For a non-memory linear mapping, such as a scan line oriented one, more memory will be required. In FIG. 8, the half-frame buffer frame accelerator (HFB FA) is allocated 9.6K memory locations in accordance with a linear memory map.

To implement the extended frame accelerator scheme, in a preferred embodiment, four more memory areas in the remaining 128 KW of the 256K×16 DRAM are required: they are designated #1, #2, #3, and #4 HFB XFA (half-frame buffer extended frame accelerator memory areas), each occupying 9.6 KW in the 256K×16 DRAM. In non-extended mode, simultaneous CRT and panel display is available. Four flat-panel frames occur within the same time as two CRT frames. In extended mode, only shaded data buffered in the extended frame accelerator is read out of the DRAM during frames 3 and 4. CRT display is therefore not available.

Assuming 4-bits-per-pixel graphics mode, in non-extended operation, for one scan line, 640 nibbles, or 160 words, must be read out of the DRAM for display on one flat-panel half-frame. For the other flat panel half-frame, 640 bits, or 40 words, of frame accelerator buffered data must be read out of the DRAM. As this data is read out of the frame accelerator, it is overwritten by 40 words of next frame shaded data. Non-extended operations therefore requires a 240 memory cycles per scan line for each frame, or a total of 960 memory cycles per scan line over four frames.

In extended operation, the read and write cycles in the first two frames include the same read and write cycles as in the first two frames of non-extended operation. In addition, in Frame No. 1, 40 write cycles are used to write shaded data to XFA No. 1 for a half-frame following the next half-frame and 40 write cycles are used to write shaded data to XFA No. 2 for a next following half-frame (either upper or lower). During Frame No. 2, corresponding shaded data is written to XFA No. 3 and XFA No. 4 but for the opposite half-frame (upper or lower). During each of the first two half-frames, 320 memory cycles per scan line are therefore required. In Frames 3 and 4, however, the upper and lower half-frames previously stored in the four additional half-frame buffers are read out and displayed. Forty read cycles are required to read out each half-frame. A total of 80 memory cycles per scan line are therefore required for each of Frames 3 and 4. The total number of memory cycles for all four frames is therefore 800 as compared to 960 for non-extended operation, a savings of 17%. The extended frame accelerator approach therefore achieves better utilization of memory bandwidth, giving more time to CPU memory accesses or, alternatively, consuming less power than the non-extended frame accelerator approach for the same number of CPU accesses. As previously noted, power savings is an important consideration in portable systems.

In a similar manner, the savings in memory bandwidth for an 8-bits-per-pixel 640×480 graphics mode may be calculated. Non-extended frame accelerator operation requires 1,600 memory cycles over four frames, whereas extended frame accelerator operation requires only 1,120 memory cycles over four flat-panel frames. The resulting savings, 1,600–1,120=480 memory accesses per scan line over four flat-panel frames, represents 30% better memory bandwidth utilization in 8-bit-per-pixel graphics modes.

Figure 9:
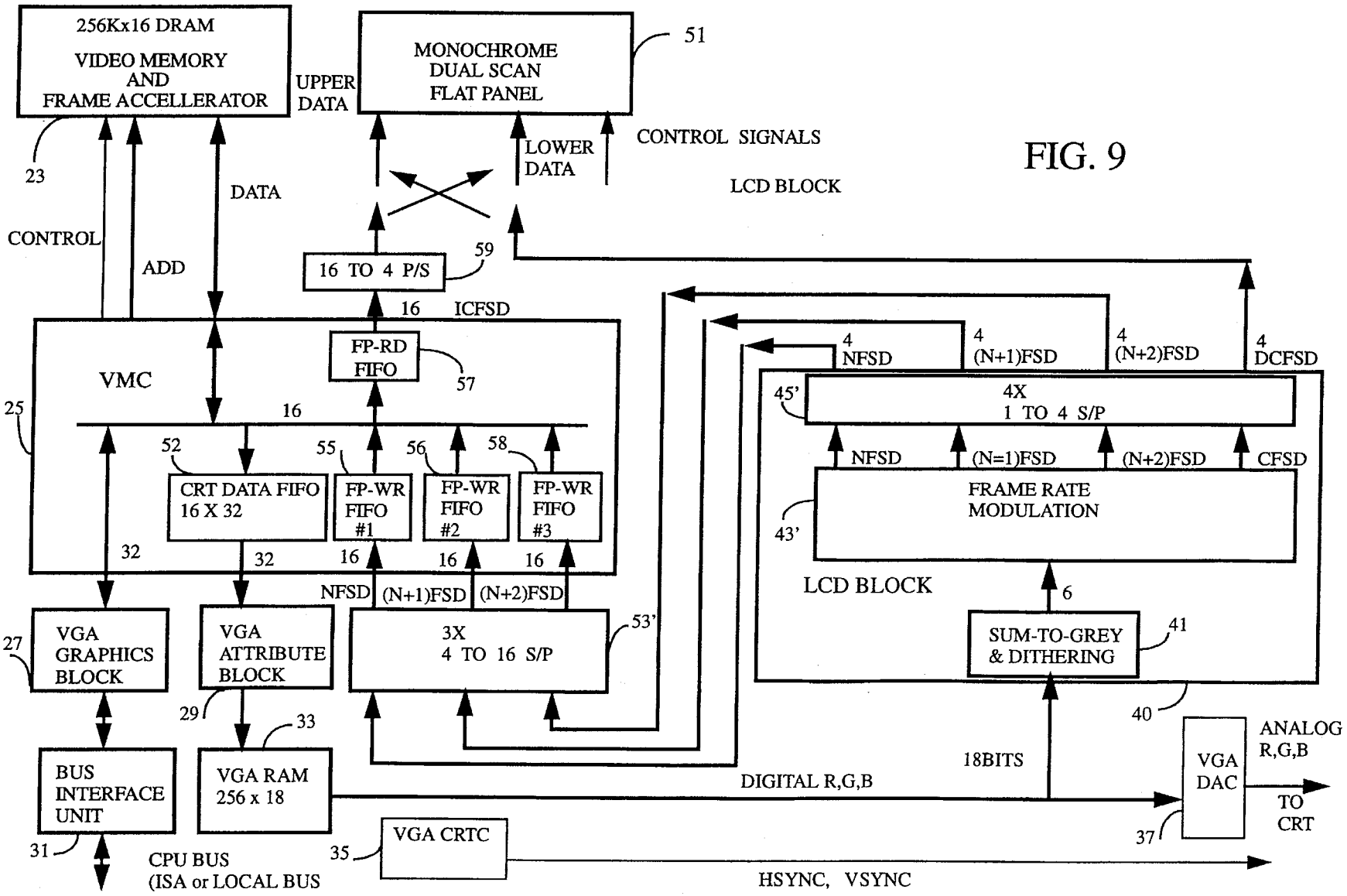
FIG. 9 is a block diagram illustrating a modification to FIG. 5 that provides for extended frame buffer operation.

Referring to FIG. 9, in order to support extended frame accelerator operation, the LCD Block 40 is modified such that the Frame Rate Modulation Block 43' generates not only the current and next frame shaded data but also the next plus 1 frame and next plus 2 frame shaded data for the third and fourth flat-panel frames. The converter 45' therefore includes four 1-to-4 serial-to-parallel converters. The current frame shaded data is sent directly to the LCD panel. The remaining three data streams are converted to a 16 bit wide format in the converter 53' consisting of three 4-to-16 serial-to-parallel converters. The three data streams are then buffered in the Write FIFO 55 used for non-extended frame accelerator operation and two additional Write FIFOs 56 and 58. The three data streams are generated simultaneously but are written to the extended frame accelerator half-frame buffer areas in the 256K×16 DRAM in turns. The areas for the extended frame accelerator half-frame buffers may be interleaved in the DRAM. At read time, the appropriate address generation is then used in order to read only the data corresponding to the flat-panel frame to be displayed. In the embodiment of FIG. 9, the video memory controller memory cycle arbiter accommodates flat-panel cycles from the two new FIFOs in addition to the flat-panel cycles for the Write FIFO 55 and the Read FIFO 57.

For extended frame accelerator operation, the memory address generation circuitry of FIG. 7 is also changed in order to address the area needed to store the two extra frames of flat-panel data.

Figure 10:
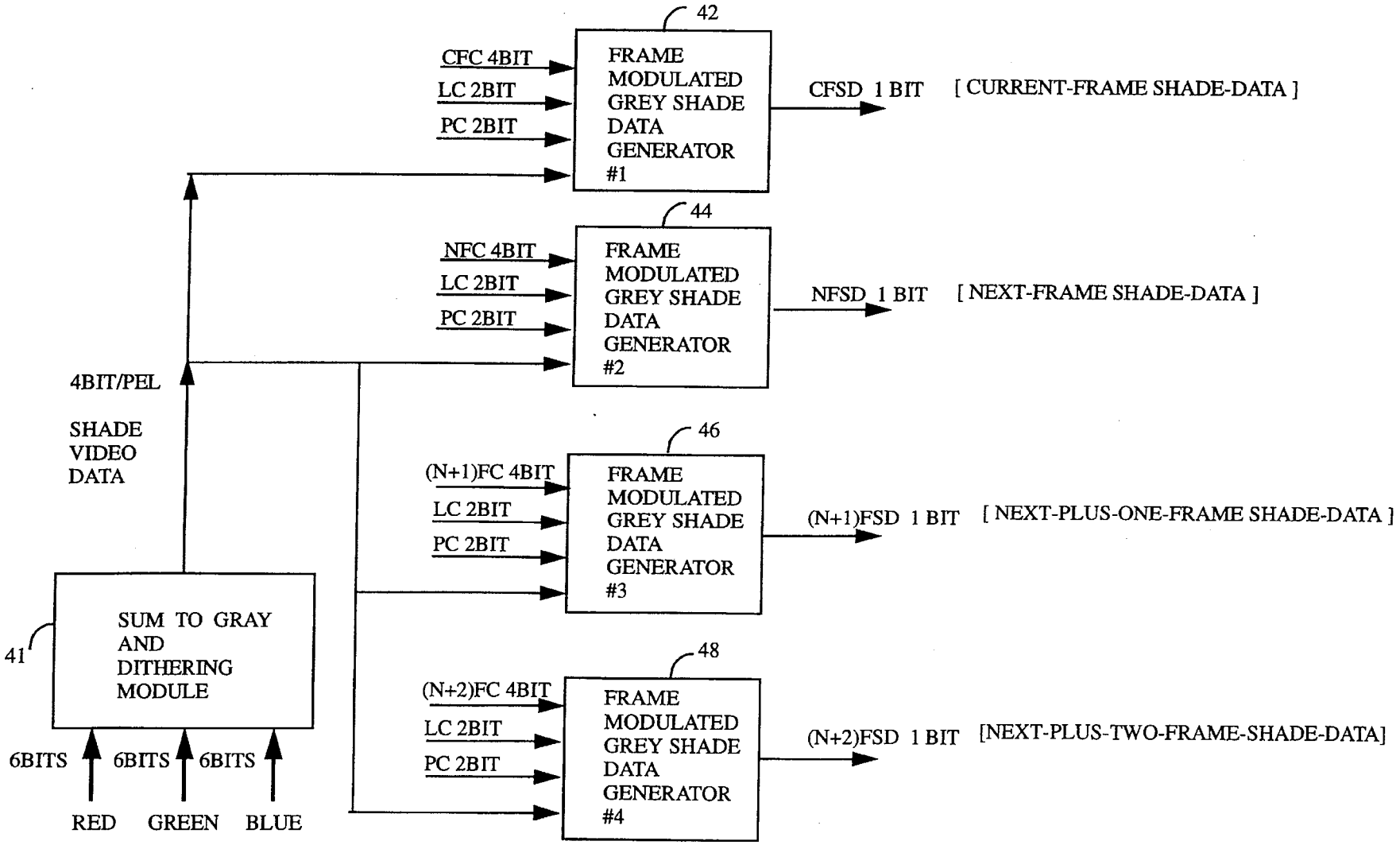
FIG. 10 is a block diagram showing in greater detail the frame rate modulation block of FIG. 9.

FIG. 10 shows in greater detail the Frame Rate Modulation block 43' of FIG. 9. Instead of two frame modulated grey shaded generators as in the non-extended half-frame buffer frame accelerator approach, generating data for only the current flat-panel frame (csfd) and the next flat-panel frame (nsfd), four frame modulated grey shaded generators generate data for the current panel frame (csfd), the next flat-panel frame (nsfd), the next plus 1 flat-panel frame ((n+1) fsd), and the next plus 2 flat-panel frame ((n+2 fsd)). In the embodiment of FIG. 10, 6 bits of red, green and blue data from the VGA RAM 33 is input to the Sum-to-Grey and Dithering module 41, which outputs a 4 bit signal used to select one of 16 basic shades to be displayed. The number of basic shades as well as the way in which they are generated can vary and does not form any part of the present invention. Similarly, the specific shade generation algorithm does not form any part of the present invention. The number of bits in the frame counters cfc, nfc (n+1)fc, and (n+2)fc, as well as the number of bits in the line counter lc and the pixel counter pc, depends entirely on the frame modulation shading algorithm used.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in the embodiments by workers skilled in the art without departing from the scope of the present invention as defined by the following claims.

What is claimed is:

1. A display apparatus to display video information on a dual scan flat panel display device, comprising:

a single memory array having a display memory area and a frame buffer area;

a video controller for causing video information to be displayed on the dual scan flat-panel display device, the video controller reading display data from the display memory area, and storing display data into and retrieving display data from the frame buffer area of the single memory array during display of a frame of the video information, the video controller comprising:

memory cycle arbitration and sequencer for deciding when to retrieve display data from or store display data into said single memory array;

a flat-panel write cycle FIFO with associated full and empty logic;

a flat-panel read cycle FIFO with associated full and empty logic for reading display data from the frame buffer; and a CRT read cycle FIFO with associated full and empty logic for receiving display data from the display memory area, wherein the flat panel write cycle FIFO, the flat-panel read cycle FIFO and the CRT read cycle FIFO are all operatively connected to the single memory array;

means responsive to display data read from the display memory area of the single memory array to produce frame-rate modulated, grey-shaded data; and formatting means for converting frame-rate modulated, grey-shaded data from a data width of the flat-panel display to a data width of the single memory array, the formatting means also converting the display data in the CRT read cycle FIFO from the data width of the single memory array to the data width of the flat-panel display device;

wherein said video controller stores through the flat-panel write cycle FIFO into the frame buffer area the display data converted to the data width of the single memory array, and causes to be displayed on the dual scan flat-panel display device the data converted to the data width of the flat-panel device.

2. A method of operating the apparatus of claim 1, comprising the steps of:

during a blanking interval of the flat-panel display device, filling the flat-panel read cycle FIFO with display data from the frame buffer area of the single memory array; and at intervals during an active display period, writing multiple stages of data from the flat-panel write cycle FIFO to the frame buffer area of the single memory array and thereafter reading multiple stages of data from the frame buffer area of the single memory array into the flat-panel read cycle FIFO, whereby no delay is incurred during a transition from write cycles to read cycles.

3. A method of displaying video data on a flat-panel display device having a plurality of display panels, comprising the steps of:

producing video data corresponding to a first picture element to be displayed on one of said plurality of display panels;

mapping said video data corresponding to first picture element into a first temporal sequence of display data to be successively displayed at said first picture element to create at said first picture element a visual impression in accordance with said video data;

sending a first one of said display data in said first temporal sequence to said one of said plurality of display panels;

storing a plurality of said display data, occurring after said first one of said data in said temporal sequence, in a buffer memory;

during a same refresh cycle, retrieving from said buffer memory a display data previously stored in said buffer memory and sending said display data to another of said plurality of display panels;

during a next screen refresh cycle, retrieving from said buffer memory and sending to said one display panel a next one of said plurality of display data in said temporal sequence for display at said first picture element;

during said next screen refresh cycle:

retrieving from said buffer memory a display data previously stored in said buffer memory and sending said display data to said one of said plurality of display panels;

producing video data corresponding to a second picture element to be displayed on said another display panel;

performing a mapping of said video data corresponding to said second picture element onto a second temporal sequence of display data to be successively displayed at said second picture element to create at said second picture element a visual impression in accordance with said video data;

sending a first one of said display data in said second temporal sequence to said another of said display panels;

storing a plurality of said display data, occurring after said first one of said display data in said second temporal sequence, in said buffer memory; and during each of a following screen refresh cycle after said next screen refresh cycle and a next following screen refresh cycle after said following screen refresh cycle:

retrieving a display data previously stored in said buffer memory and sending said display data to said one of said plurality of display panels; and retrieving a display data previously stored in said buffer memory and sending said display data to said another of said plurality of display panels.

4. A display apparatus to display video information on a dual scan flat panel display device, comprising:

a single memory array having a display memory area and a frame buffer area, the display memory area storing display data corresponding to video information to be displayed;

a video memory controller having a read FIFO, a write FIFO, and a CRT FIFO, the CRT FIFO receiving the display data of a present frame from the display memory area, the write FIFO receiving grey-shaded data corresponding to the present frame and storing the received grey-shaded data into the frame buffer area, the read FIFO receiving the grey-shaded data of a previous frame from the frame buffer area and sending the received grey-shaded data of the previous frame for display on a first half of the dual scan flat panel display device;

a dithering circuit for receiving display data corresponding to the present frame from the CRT FIFO of the video memory controller and generating the grey-shaded data of the present frame; and a frame rate modulation circuit coupled to the dithering circuit to receive the grey-shaded data of the present frame and to the write FIFO to provide the write FIFO with the grey-shaded data of the present frame, the frame modulation circuit displaying the grey-shaded data of the present frame on the second half of the dual scan flat panel display device.

5. The display apparatus of claim 4 wherein data width of the single memory array is different from data width of the dual scan flat panel device, and wherein the grey shaded data corresponds to the data width of the dual scan flat panel device.

6. The display apparatus of claim 5 further comprising a first converter for converting the grey shaded data to the data width of the single memory array, the first converter sending the converted grey shaded data to the write FIFO.

7. The display apparatus of claim 6 further comprising a second converter for receiving the grey-shaded data from the read FIFO and for converting the received data into the data width of the dual scan flat panel device.

8. A computer system comprising:

a CPU bus;

a dual scan flat panel display device; and a display apparatus to display video information on the dual scan flat panel display device, comprising:

a single memory array having a display memory area and a frame buffer area, the single memory array receiving display data corresponding to video information to be displayed over the CPU bus and storing display data in the display memory area;

a video memory controller having a read FIFO, a write FIFO, and a CRT FIFO, the CRT FIFO receiving the display data of a present frame from the display memory area, the write FIFO receiving a grey-shaded data corresponding to the present frame and storing the received grey-shaded data into the frame buffer area, the read FIFO receiving the grey-shaded data of a previous frame from the frame buffer area and sending the received grey-shaded data of the previous frame for display on a first half of the dual scan flat panel display device;

a dithering circuit for receiving display data corresponding to the present frame from the CRT FIFO of the video memory controller and generating the grey-shaded data of the present frame; and a frame rate modulation circuit coupled to the dithering circuit to receive the grey-shaded data of the present frame and coupled to the write FIFO to provide the write FIFO with the grey-shaded data of the present frame, the frame modulation circuit displaying the grey-shaded data of the present frame on the second half of the dual scan flat panel display device.

9. The display apparatus of claim 8 wherein data width of the single memory array is different from data width of the dual scan flat panel device, and wherein the grey shaded data area corresponds to the data width of the dual scan flat panel device.

10. The display apparatus of claim 9 further comprising a first converter for converting the grey shaded data to the data width of the single memory array, the first converter sending the converted grey shaded data to the write FIFO.

11. The display apparatus of claim 10 further comprising a second converter for receiving the grey-shaded data from the read FIFO and for converting the received data into the data width of the dual scan flat panel device.

* * * * *